US006752934B2

(12) United States Patent
Reinhard et al.

(10) Patent No.: US 6,752,934 B2
(45) Date of Patent: Jun. 22, 2004

(54) VAPOR-PHASE CORROSION INHIBITORS AND METHOD OF PREPARING SAME

(75) Inventors: George Reinhard, Dresden (DE); Urte Ludwig, Dresden (DE); Gerhard Hahn, Munden (DE)

(73) Assignee: EXCOR Korrosionsforschung GmbH, Dresden (DE)

( * ) Notice: Subject to any disclaimer, the term of this patent is extended or adjusted under 35 U.S.C. 154(b) by 99 days.

(21) Appl. No.: 10/135,867

(22) Filed: Apr. 30, 2002

(65) Prior Publication Data

US 2003/0031583 A1 Feb. 13, 2003

(30) Foreign Application Priority Data

Jul. 30, 2001 (DE) ..... 101 37 130

(51) Int. Cl.[7] ..... C23F 11/02
(52) U.S. Cl. ..... 252/389.61; 252/389.62
(58) Field of Search ..... 252/389.5–389.62, 252/392, 393, 396

(56) References Cited

U.S. PATENT DOCUMENTS

| | | | | |
|---|---|---|---|---|
| 2,419,327 A | | 4/1947 | Wachter et al. | 252/392 |
| 2,432,839 A | | 12/1947 | Wachter et al. | 252/392 |
| 2,432,840 A | | 12/1947 | Watcher et al. | 262/392 |
| 2,941,953 A | | 6/1960 | Hatch | 262/389 |
| 3,295,917 A | | 1/1967 | Cotton et al. | 21/2.5 |
| 3,836,077 A | | 9/1974 | Skildum | 239/60 |
| 3,887,481 A | | 6/1975 | Korpics | 252/172 |
| 3,967,926 A | | 7/1976 | Rozenfeld et al. | 21/2.5 B |
| 4,051,066 A | | 9/1977 | Miksic et al. | 252/389 |
| 4,124,549 A | | 11/1978 | Hashiudo et al. | 260/18 N |
| 4,200,542 A | | 4/1980 | Sedlak | 262/25 |
| 4,275,835 A | | 6/1981 | Miksic et al. | 239/60 |
| 4,290,912 A | | 9/1981 | Boerwinkle et al. | 252/389 |
| 4,973,448 A | | 11/1990 | Carlson et al. | 422/9 |
| 5,209,869 A | | 5/1993 | Miksic et al. | 252/389 |
| 5,332,525 A | | 7/1994 | Miksic et al. | 252/389 |
| 5,393,457 A | | 2/1995 | Miksic et al. | 252/194 |
| 6,033,599 A | * | 3/2000 | Lozano et al. | 252/389.54 |
| 6,383,271 B1 | | 5/2002 | Schmidt | 106/14.41 |
| 2001/0032966 A1 | | 10/2001 | Schmidt | 252/387 |

FOREIGN PATENT DOCUMENTS

| | | |
|---|---|---|
| DE | 814725 | 7/1949 |
| DE | 1182503 | 11/1966 |
| DE | 1521900 | 5/1969 |
| DE | 3545473 A1 | 7/1987 |
| DE | 268978 B1 | 10/1990 |
| DE | 295668 A5 | 11/1991 |
| DE | 298662 A5 | 3/1992 |
| DE | 4040586 | 6/1992 |
| DE | 19708285 A1 | 9/1998 |
| EP | 0522161 A1 | 1/1993 |
| EP | 0639657 A1 | 2/1995 |
| EP | 0662527 A1 | 7/1995 |
| GB | 600328 | 4/1948 |
| GB | 1224500 | 3/1971 |
| JP | 58063732 A | 4/1983 |

OTHER PUBLICATIONS

Grant, J. (Ed.), "Hackh's Chemical Dictionary" Fourth Edition, (McGraw–Hill, 1972), pp. 107, 127, 666.*
A.D. Mercer, Proceedings of the 7$^{th}$ European Symposium on Corrosion Inhibitors, Ann. Univ. Ferrara, Italy, N.S. Sez, V. Suppl. 9 (1990) pp. 449–469.
Japio Abstract; JP 89–214003 (Aug. 18, 1989).
Japio Abstract; JP 84–134072 (Jun. 30, 1984).
PAJ Abstract; JP 62–063686 (Mar. 20, 1987).
PAJ Abstract; JP 61–227,188 (Oct. 9, 1986).
PAJ Abstract; JP 63–128,888 (Feb. 6, 1988).
PAJ Abstract; JP 63–183,182 (Jul. 28, 1988).
PAJ Abstract; JP 63–210,285 (Aug. 31, 1988).
Japio Abstract; JP 88–236,756 (Sep. 21, 1988).
Japio Abstract; JP 85–248974 (Nov. 8, 1985).
PAJ Abstract; JP 05–093,286 (Apr. 16, 1993).
PCT Abstract; WO 91/09096 (Jun. 27, 1991).

* cited by examiner

*Primary Examiner*—Matthew A. Thexton
(74) *Attorney, Agent, or Firm*—Duane Morris LLP

(57) ABSTRACT

Substance combinations which contain (1) an inorganic salt of nitrous acid, (2) a water-insoluble polysubstituted phenol, (3) an aliphatic ester of a dihydroxybenzoic acid, and (4) a tocopherol plus optionally (5) a suitable water vapor-volatile bicyclic terpene or an aliphatically substituted naphthalene which promotes sublimation of the components present in the respective substance combination, especially in air at a relatively high atmospheric humidity, and the use of such substance combinations as vapor phase corrosion inhibitors in packaging or in storage in closed spaces for protection of the conventional metals for use such as iron, chromium, nickel, tin, zinc, aluminum, copper and their alloys against atmospheric corrosion are described.

17 Claims, No Drawings

VAPOR-PHASE CORROSION INHIBITORS AND METHOD OF PREPARING SAME

FIELD OF THE INVENTION

The present invention relates to corrosion inhibitors and more particularly to combinations of substances for use as vapor-phase corrosion inhibitors (volatile corrosion inhibitors, VCI) for protecting conventional metals for use, such as iron, chromium, nickel, tin, zinc, aluminum, copper and alloys thereof, from atmospheric corrosion.

BACKGROUND OF THE INVENTION

It is already known in general that corrosion inhibitors which tend to undergo sublimation in powder form under normal conditions and can reach metal surfaces that are to be protected through the gas phase, can be used for temporary corrosion prevention on metal objects within closed spaces, e.g., in packaging or in display boxes.

These vapor-phase inhibitors (VPI) or volatile corrosion inhibitors (VCI) are usually selected according to the type of metal to be protected and are used in the form of a powder packaged in a bag of a material that is permeable for the vapor-phase inhibitors (see, for example, H. H. Uhlig, *Corrosion and Corrosion Prevention*, Akademie-Verlag Berlin, 1970, pages 247–249; K. Barton, *Protection Against Atmospheric Corrosion*; Theory and Practice, Verlag Chemie, Weinheim 1973, pages 96 ff. or I. L. Rozenfeld, *Corrosion Inhibitors* (Russian) Izt-vo Chimija, Moscow 1977, page 320 ff; A. D. Mercer, *Proceedings of the 7th European Symposium on Corrosion Inhibitors*, Ann. Univ. Ferrara/Italy, N. S., Sez V, Suppl. No. 9 (1990), 449 pp.).

Modern packaging materials for corrosion prevention contain VCIs either in tablet form within porous foam capsules or as a fine powder inside of polymer carrier materials. For example, U.S. Pat. Nos. 3,836,077, 3,967,926, 5,332,525, 5,393,457, 4,124,549, 4,290,912, 5,209,869, Japanese Patent 4,124,549, European Patent 0,639,657 and Unexamined German Patent 3,545,473 propose several variants whereby VCIs are introduced in the form of capsules or air-permeable plastic films, either by incorporation into cavities created by cutting open a foam and subsequently covering same with a gas-permeable material or by adding the VCI to the polymer melt intended for melt extrusion or blow molding, thus resulting in a packaging material (film or hard material) out of which the VCI components are able to sublime continuously because of the structurally induced porosity.

There have already been attempts to incorporate VCIs during foaming of polymeric solids, as described for example in Japanese Patent 58,063,732, U.S. Pat. No. 4,275,835 and German Democratic Republic Patent 295,668. In addition, packaging materials containing VCI can be produced by dissolving the VCI components in a suitable solvent and applying this solution to the respective packaging material. Methods of this type using various active ingredients and solvents are described, for example, in Japanese Patents 61,227,188, 62,063,686, 63,028,888, 63,183,182, 63,210,285, German Patent 1521900 and U.S. Pat. No. 3,887,481.

However, the VCI packaging materials produced in this way usually contain the active ingredients incorporated only loosely in the structurally induced cavities in the carrier material, whether paper, cardboard, foam, etc., so there is the danger of mechanical rupturing and escape of the active ingredient particles, so it is impossible to ensure that carrier materials pretreated in this way will still have the required specific surface concentration of VCI at the time of their use for corrosion prevention.

To eliminate this disadvantage, U.S. Pat. No. 5,958,115 describes a corrosion-inhibiting composite material which consists of a mixture of metal oxide sol, corrosion inhibitors that are capable of sublimation and additional additives and forms a firmly adhering, sufficiently porous gel film of the metal oxides and additives used on the support material, so that the corrosion inhibitors (VCIs) are released from the film at a uniform, long-lasting emission rate.

According to the ISO definition, a corrosion inhibitor is a "chemical substance which decreases the corrosion rate when present in the corrosion system at a suitable concentration without significantly changing the concentration of any other corrosive agent; the use of the term inhibitor should be qualified by the nature of the metal and the environment in which it is effective" (cf. Corrosion of metals and alloys—Terms and definitions, ISO 8044–1986).

The main principle in the use of VCIs is to maintain or reinforce the inherent primary oxide layer, which usually provides only limited protection but which forms very rapidly on any metal due to contact with the atmosphere, although it cannot be perceived visually without optical aids (K. Barton, loc. cit.; E. Kunze (eds.), *Corrosion and Corrosion Protection*, volume 3, Wiley-VCH, Berlin, Weinheim, New York 2001, pages 1680 ff.).

With regard to the type and properties of said primary oxide layer, the known utilitarian metals and their alloys may be divided into two categories, namely the passivatable metals, where a sufficiently strong oxidizing agent is required to maintain or recreate the protective primary oxide layer, and those metals which are classified as non-passivatable, where the passive oxide layer undergoes chemical and/or structural changes due to the action of strong oxidizing agents so that adhesion to the substrate and thus also the corrosion-preventing effect are lost.

To illustrate this distinction between the two categories of utilitarian metals, the following examples shall be used. In the ferrous materials which belong to the category of passivatable metals, the primary oxide layer consists mainly of Fe(III) oxides, for example. If the metal surface becomes moistened, which is the case when a condensed film of water develops in rooms saturated with water vapor due to a drop in temperature when a sufficiently strong oxidizing agent is not in effect at the same time, then corrosion of the metal begins by conversion of these oxides into Fe(II) compounds, e.g.:

$$Fe_2O_3+H_2O+2H^++2e^- \rightleftharpoons 2Fe(OH)_2$$

and for the anodic step of corrosion of the substrate metal:

$$Fe+2H_2O \rightarrow Fe(OH)_2+2H^++2e^-$$

they function cathodically.

Metals that must be classified in the category of non-passivatable metals include, for example, copper whose primary oxide layer is sensitive to further oxidation. Its primary oxide layer is known to consist mainly of the oxide $Cu_2O$ and it is stable only in aqueous media which do not contain any strong oxidizing agent, regardless of pH. Under the action of oxygen in humid air, however, the oxide CuO is formed relatively rapidly and is detectable as a black deposit which cannot become intergrown with the metal substrate because of its crystal lattice dimensions (no epitaxy) and therefore cannot provide any corrosion protection. The following equation can be formulated for the starting reactions of atmospheric corrosion of copper:

$$Cu_2O+H_2O \rightarrow 2CuO+2H^++2e^-$$

$$\frac{1}{2}O_2+2H^++2e^- \rightarrow H_2O$$

and as the gross reaction which eliminates the passive state:

$$Cu_2O+\frac{1}{2}O_2 \rightarrow 2CuO$$

Most conventional utilitarian metals are considered to be passivatable on contact with aqueous media. Thus, the case with nickel is similar to that with iron because its primary oxide layer contains $Ni_2O_3$. In the case of chromium, the passive state is caused by $Cr_2O_3$/CrOOH, and in the case of tin it is caused by SnO/$SnO_2$, in the case of zinc it is caused by ZnO and in the case of aluminum by $Al_2O_3$/AlOOH. These passive oxide layers are usually maintained in neutral aqueous media or they form again spontaneously after local mechanical abrasion (abrasion, erosion) when the action of a sufficiently strong oxidizing agent is guaranteed (E. Kunze, loc. cit.).

Nitrites as salts of nitrous acid have already proven very successful as passivating oxidizing agents of this type. Therefore, they have long been used as vapor-phase inhibitors. The relatively volatile dicyclohexylammonium nitrite has already been in use as a vapor-phase inhibitor for more than 50 years (see Uhlig, Barton, Rozenfeld, Kunze, loc. cit.) and is mentioned as a component of VCI compositions in numerous patent publications (e.g., U.S. Pat. Nos. 2,419,327, 2,432,839, 2,432,840, 4,290,912, 4,973,448, Japanese Patents 02085380, 62109987, 63210285 A and German Patent 4040586). The effect of the nitrite ion as an oxidizing agent is associated with its electrochemical reduction, for which the following reactions may be formulated, for example:

$$2NO_2^-+2H^++2e^- \rightleftharpoons 2NO+2OH^-$$

$$NO_2^-+3H_2O+2H^++6e^- \rightleftharpoons NH_3+5OH^-$$

Since these reactions lead only to the formation of hydroxyl ions, $OH^-$, they proceed less intensely in aqueous media the higher the prevailing pH of the medium.

From this standpoint it is not advantageous that dicyclohexylamine or the dicyclohexylammonium ion formed by dissociation of dicyclohexylammonium nitrite establishes pH values of approx. 9 in water at room temperature. This is not only a disadvantage for the manifestation of the passivator effect of the nitrite but also endangers the stability of the passive oxide layer of zinc and aluminum materials. The oxides of these metals are known to be stable only in a neutral pH range, and they undergo progressive dissolution at a pH>8, forming zincate or aluminate:

$$ZnO+H_2O+OH^- \rightleftharpoons Zn(OH)_3^-$$

$$Al_2O_3+H_2O+5OH^- \rightleftharpoons 2Al(OH)_4^-$$

In the attempt to create VCI packaging materials which can be used not only for iron metals but also at least for galvanized steels and aluminum materials, there have been attempts to formulate VCI combinations which contain not only amine nitrites but also components which have a pH regulating effect in condensed water films on metal surfaces, so the dissolution of the passive oxide layers described above cannot occur.

From this standpoint, it has been proposed that nitrite-amine mixtures should be combined with other substances that are capable of sublimation, such as the salts of weak to medium-strong, saturated or unsaturated carboxylic acids, as described, for example, in U.S. Pat. Nos. 2,419,327, 2,432,839, 2,432,840 and German Patent 814,725. To be sure, this yields improved protection of the usual Al- and Zn-materials when they are in contact with an aqueous medium or film of condensed water if the passive oxide layer is not damaged mechanically or dissolved by action of chelating agents, but the passivating properties of the nitrite are also reduced by this species at the same time. The respective carboxylates are known to create pH buffering systems of a higher buffering capacity in aqueous media or films of condensed water on metal surfaces, with or without the simultaneous presence of an amine in the absence of the respective carboxylic acid/salt system, and thus they prevent the reducibility of oxidizing agents, which is evident in principle from the reduction reactions for nitrite given above. These reactions, which are necessary for the passivation effect, are known to proceed from left to right voluntarily only if the respective reaction medium does not already have a high concentration of $OH^-$ ions or if the $OH^-$ ions that are formed are regularly removed from the medium, or if the concentration of the oxidizing agent in the medium remains comparatively much higher than that of the $OH^-$ ions formed, e.g., by virtue of the fact that the amount of oxidizing agent converted is continuously re-supplied from a source.

All the traditional applications of VCI combinations which also contain an amine or amine carboxylate in addition to an oxidizing agent such as nitrite, chromate or an organic nitro compound, may consequently be successful in practical implementation only if the oxidizing agent which has a passivating effect is used in excessive concentrations. However, this fact is not always readily apparent from the corresponding patent literature, because the concentration ranges in which the VCI combinations according to this invention may be used are generally stated very generously. Such VCI combinations containing oxidizing agents are described, for example, in GB Patent 600,328, where it is recommended that as much organic nitrite salt as possible should be used, or in German Patent 814725, where nitrite salts of organic nitrogenous bases (e.g., carboxylates, piperidines, oxazines or morpholines) are proposed under the condition that at least 0.5 to 20 g of the nitrite should be applied per square meter of packaging material, and reliable protection is achieved only when at least 35 to 600 grams of this substance are emitted per cubic meter of the interior of the package.

Practical use of the oxidizing agents mentioned above is regulated today due to their known, relatively harmful effects on people and the environment, so there are limits with regard to the concentration in preparations and the maximum allowed job site concentration (MAK value) (e.g., classification of substances and preparations according to EC Guideline 67/548/EEC including annual updates). Therefore, the VCI combinations mentioned here with excessive passivator amounts can no longer be used.

As a replacement for this, U.S. Pat. Nos. 5,209,869 and 5,332,525 and European Patent 0662527 A1 have already proposed that the VCI mixtures consisting of nitrites and amine carboxylates, with or without molybdate, should also be combined with a desiccant such as silica gel, so that the development of a condensed film of water on the metal surface to be protected and the related negative pH effect can be postponed for the longest possible amount of time. However, this proposal has the significant disadvantage that the VCI system fixed in or on the packaging material has a great tendency to absorb water from the environment due to the presence of the desiccant, which in turn leads to a negative effect on the emission rate of VCI components and thus to a reduction in the VCI corrosion-preventing effect.

On the other hand, with the increasing globalization and intertwining of the economic regions throughout the world, the demand for reliably functioning VCI systems and VCI packaging materials has greatly increased, and the use of VCI in storage and shipping processes has become much more environmentally friendly and inexpensive than the methods of temporary corrosion protection known in the past, which consisted of applying oils, fats and waxes, and whereby at the time of removal of these agents from the metal parts, large quantities of organic solutions that were difficult to dispose of were obtained.

Most of the VCI systems known in the past, which contain a nitrite and an amine at the same time, cannot yield the required reliability for the reasons mentioned above. Another uncertainty factor that has developed in the meantime is that especially the secondary amines and cyclic nitrogenous compounds such as morpholine and piperidine, which have been introduced as VCI components, are readily converted to N-nitroso compounds. These N-nitrosamines usually react as weak oxidizing agents and promote corrosion of metals. However, their carcinogenic effect is a much more important disadvantage which prevents large-scale industrial use of these VCI systems.

At first an attempt was made to eliminate this disadvantage by replacing the nitrite, because it was assumed that nitrosation of amines is caused only by the simultaneous presence of nitrite. U.S. Pat. No. 4,051,066 therefore proposes the use of m-nitrobenzoate and dinitrobenzoate instead of nitrite, while German Democratic Republic Patents 268978 and 295668 propose the use of dicyclohexylamine-o-nitrophenolate and dicyclohexylamine-m-nitrobenzoate. Finally, GB Patent No. 1,224,500 generalizes regarding the use of volatile aliphatic and aromatic nitro compounds together with heterocyclic amines and mentions 2-nitropropane, nitrobenzene and dinitrobenzene specifically. First, however, the passivator properties of these alternative oxidizing agents have proven to be much weaker in comparison with those of nitrite and secondly, the intended effect of avoiding the formation of N-nitrosamine with the amines used at the same time was not achieved. In the meantime, it is known that such well-proven VCI components as morpholine and dicyclohexylamine undergo nitrosation due to the normal constituents of air, in particular in contact with metals and at high temperatures. This virtually prevents their incorporation into plastics, because melt extrusion, injection molding or blow molding are known to be performed at temperatures around 200° C. in metallic installations.

To satisfy the demand for films and hard plastics finished with VCI for handling overseas shipments, it has been proposed that amine-free VCI systems containing nitrite be used. For example, U.S. Pat. No. 3,836,077 describes a combination of nitrite with borate and a phenol which is mono-, di- or trisubstituted with styrene. The purpose of using such phenols with aromatic substituents was not explained in this patent specification, but it can be assumed that they are intended to function as antioxidants merely to ensure the stability of the polyolefin films against the oxidative effect of the nitrite which is present in large amounts. Only small amounts of nitrite will sublime out of films produced from polyethylene and combinations thereof as long as the phenyl-beta-naphthylamine, which is also claimed in that patent specification, is not additionally incorporated. The emission rate of the nitrite is improved by the presence of this amine, but this does not meet the goal of remaining amine-free. Furthermore, with this amine it is not possible to achieve sublimation of borate and the aromatically substituted phenols.

U.S. Pat. No. 4,290,912, however, emphasizes the use of inorganic nitrites in combination with a triple-substituted phenol and silica gel for production of VCI films, but the embodiments prove that in the case of phenols, only aliphatically substituted phenols and especially 2,6-di-tert-butyl-4-methylphenol (butylated hydroxytoluene, BHT) are intended. Since these substituted phenols have a tendency to sublimation even at normal temperature, an improved sublimation rate can be achieved with this combination, even for sodium nitrite or potassium nitrite, without the involvement of a volatile amine, but the nitrite reaching the metal surface cannot achieve reliable VCI corrosion protection without the use of additional components. In the case of passivating metals, it is necessary to have the cooperation of components which adjust the pH in condensed water films in a range that is favorable for passivation and which stabilize the passive oxide layer that is formed by adsorption to prevent dissolution (see, for example, E. Kunze, loc. cit.). In the simultaneous presence of non-passivating metals such as copper materials, exclusive action of a nitrite would also result in increased corrosion.

Benzotriazole has long been used for protecting copper and copper alloys from atmospheric corrosion (see, for example, Barton, Mercer, loc. cit.). However, since the sublimation tendency of this compound is relatively low, German Patent 1182503 and U.S. Pat. No. 3,295,917 propose that the source of this VCI should first be adjusted to a higher temperature (up to approx. 85EC.) and at the same time the metal objects on which condensation is to take place should be cooled. U.S. Pat. Nos. 2,941,953 and 3,887,481, however, describe the impregnation of paper with benzotriazole and/or tolyltriazole. Organic solvents such as tetrachloroethylene are used, and it is specified that the metal parts to be protected should be wrapped as tightly and as closely as possible with the VCI packaging material impregnated in this way to minimize the distance between the VCI source and the metal surface to be protected. However, this technology has the disadvantage mentioned above that the active ingredient in the form of extremely fine particles of powder does not adhere well to the paper and can easily slip off, so the corrosion-preventing properties of this packaging material cannot be reliable.

The sublimation tendency of benzotriazole and tolyltriazole from VCI source also increases, like that of inorganic nitrites and nitrates, when other sublimable solids in powder form are also incorporated at the same time. In this regard, European Patent 0662527 mentions mixtures of benzotriazole with cyclohexylaminebenzoate and ethylaminebenzoate or with anhydrous sodium molybdate and dicyclohexylamine nitrite, while U.S. Pat. No. 4,051,066 and U.S. Pat. No. 4,275,835 mention mixtures of benzotriazole with ammonium molybdate and amine molybdates, aminebenzoates and nitrates, U.S. Pat. No. 4,973,448 describes mixtures of benzotriazole with organic carbonates, phosphates and amines; finally, Japanese Patents 62063686 and 63210285 A mention mixtures of benzotrizaole with alkali and amine salts of aromatic carboxylic acids.

Combinations of benzotriazole, tolyltriazole or methylbenzotriazole with other volatile organic nitrogen solids are described, for example, in Japanese Patents 62109987 and 61015988, German Democratic Republic Patents 268978 and 298662. One disadvantage is that all the components containing amine and ammonium ions reduce the protective effect of triazoles, especially with regard to the nonferrous metals because of their rather pronounced tendency to form complexes with metal ions. In addition, these amines and ammonium compounds are highly hydrophilic. VCI sources containing such substances have a tendency to increased uptake of water, as already mentioned above. Their hydrolysis then usually results in a marked reduction in their sublimation tendency, which necessarily results in a reduction in the corrosion-preventing effect.

To utilize the advantages of using VCI and the inhibitor effect of the triazole structure, Japanese Patent 03079781 proposes that instead of the substance combinations of triazole and amine, only alkylaminotriazoles should be used. In fact, the substances mentioned explicitly, namely 3-amino-1,2,4-triazole and 3-amino-5-methyl-1,2,4-triazole, have a higher rate of volatilization, but do not have such a definite corrosion-preventing effect with respect to copper as do benzotriazole and tolyltriazole.

Further vapor-phase corrosian inhibitors are described in DE 39 40 803, DE 199 03 400, DE 100 13 471, U.S. Pat. No. 4,200,542, EP 522 161 and JP 05-093 286.

If hard plastics and plastic films equipped with VCI components are to be made available for modern packaging, shipping and storage technologies, and if VCI additives which are capable of guaranteeing VCI corrosion protection for the broadest possible range of utilitarian metals are to be used, then essentially the following problems must be overcome for their production:

first, the high volatility of the VPI at temperatures at which the extrusion process is performed must be calculated into the process, because this can lead to extensive transfer of the inhibitors to the gaseous state and thus to significant losses of these substances and to foaming of the film, as well as violation of its intactness and thus to uncontrolled reduction in its strength and protective properties;

secondly, it should be recalled that thermal decomposition of the corrosion inhibitors and chemical reactions of the components with one another and with the polymer matrix may occur in the course of processing of these mixtures during the extrusion process. This results on the whole in the significant advantage that many of the VPIs customary in the past are no longer applicable in this way and must be replaced by new types of active ingredients.

The object of this invention is to provide sublimable corrosion-inhibiting substances and substance combinations that are improved in comparison with the traditional corrosion inhibitors whose advantages are described above, such that the substances and combinations of substances will sublime from the corresponding source in particular under climate conditions that are of practical interest inside industrial packages and similar closed spaces at an adequate rate, and after adsorption and/or condensation on the surface of metals in said space, said substances will ensure conditions therein under which the conventional utilitarian metals will be reliably protected from atmospheric corrosion. Furthermore, another object of this invention is to provide methods of producing and processing such substances and substance combinations for production of improved VCI packaging materials.

SUMMARY OF THE INVENTION

These and other objects are achieved in accordance with the present invention which comprises a corrosion-inhibiting substance combination containing an inorganic salt nitric acid; a water-insoluble polysubstituted phenol; an aliphatic ester of a dihydroxybenzylic acid; and tocopherol (2,5,7,8-tetramethyl-2-(4',8',12'-trimethyltridecyl) chroman-6-ol). The present invention also comprises a method of producing a corrosion-inhibiting substance combination that is capable of sublimation, wherein an inorganic salt of nitric acid; a water-insoluble polysubstituted phenol; an aliphatic ester of a dihydroxybenzylic acid; and tocopherol are mixed together.

DETAILED DESCRIPTION

The basic idea of this invention consists of providing substance combinations that are capable of sublimation and contain the following components:

(1) an inorganic salt of nitrous acid,
(2) a water-insoluble polysubstituted phenol,
(3) an aliphatic ester of a dihydroxybenzoic acid, and
(4) tocopherol (2,5,7,8-tetramethyl-2-(4',8',12'-trimethyltridecyl)chroman-6-ol).

Furthermore, a bicyclic terpene or an aliphatically substituted naphthalene may optionally also be added as component (5) in coordination with components (1) through (4); this contributes to the fact that a sufficiently high emission rate results from these substance combinations consisting of representatives of components (1) through (4) even at relatively low temperatures and in air with permanently high levels of relative atmospheric humidity, and thus the reliability of the VCI corrosion protection is further improved.

According to this invention, these substance combinations are used directly in the form of corresponding powdered mixtures or they are incorporated according to known methods as part of the production of VCI packaging materials, so that these packaging materials function as a VCI source and allow the corrosion-preventing properties of the substance combinations according to this invention to be manifested to particular advantage.

This invention also relates to the use of the amplified substance combinations as vapor-phase corrosion inhibitors in packages or in storage in closed spaces for protection of conventional utilitarian metals, such as iron, chromium, nickel, tin, zinc, aluminum, copper and their alloys to protect them against atmospheric corrosion. The substance combinations according to this invention are used in particular to protect the broad range of conventional utilitarian metals and their alloys in packages and during storage in similar closed spaces from atmospheric corrosion.

The object of this invention is also a corrosion-inhibiting material containing one component which is an inorganic salt of nitrous acid and due to its oxidizing power on passivatable metals, causes the spontaneous formation of a passive oxide layer; also containing another component which is a poly-substituted phenol and is not soluble in water due to its properties but is adsorbable well on metal surfaces covered with a passive oxide, contributes to the stabilization of such metal surfaces from corrosion; also containing a component which is an aliphatic ester of a dihydroxybenzoic acid and surprisingly supports the effect of nitrites as a passivator and also contributes to the adsorptive stabilization of passive oxide layers; also containing a component which is a tocopherol (2,5,7,8-tetramethyl-2-4',8',12'-trimethyltridecyl)chroman-6-ol) and surprisingly inhibits the attacks of atmospheric oxygen or the nitritic component (1) in non-passivatable metals because of its property of functioning as an antioxidant, and also completely suppresses chemical reactions between the other components of the substance combinations according to this invention, so that their long-term stability is guaranteed; and finally also containing as another component a bicyclic terpene or an aliphatically substituted naphthalene, which because of its relatively high sublimation pressure and water vapor volatility, also functions as a carrier substance for the transport of active ingredients (1) through (4) through the gas space to the metal surface to be protected even at low temperatures and in the presence of atmospheric humidity with high relative atmospheric humidity levels, without having a negative corrosion-promoting effect on same but instead ensuring that the corrosion-preventing effect of the substance combinations according to this invention can be manifested fully. At the same time, a composition according to this invention may contain at least one inert filler.

The components provided according to this invention are advantageously only substances which can be processed easily and at no risk according to essentially known methods and can be classified as nontoxic and harmless to the environment in the quantity amounts to be used. Therefore, they are especially suitable for producing corrosion-preventing packaging materials which can be used inexpensively and without potential risk on a large scale.

For the introduction of the substance combinations according to this invention into VCI sources or into packaging materials which function as such, it is expedient to mix together the individual substances in an anhydrous form as thoroughly as possible according to known methods.

The substance combinations according to this invention are preferably formulated within the following weight ratios:

| | |
|---|---|
| component (1): | 0.1 to 40% |
| component (2): | 0.5 to 40% |
| component (3): | 0.5 to 40% |
| component (4): | 0.5 to 40% |
| or when using all five components | |
| component (1): | 0.1 to 40% |
| component (2): | 0.5 to 30% |
| component (3): | 0.5 to 20% |
| component (4): | 0.5 to 20% |
| component (5): | 0.1 to 10% |

This invention will now be explained in greater detail through the following examples. As they show, the type and quantity of individual components in the mixture according to this invention and the quantity in the mixture in the respective VCI source will depend on the metal to be protected as well as the production conditions used for the respective VCI packaging material.

EXAMPLE 1

The following substance combination according to this invention was prepared from the anhydrous substances:

30.0 wt % sodium nitrite
9.0 wt % 2,6-di-tert-butyl-4-methoxyphenol
11.7 wt % 2-(2H-benzotriazol-2-yl)-4-methylphenol
16.7 wt % 2,4-dihydroxybenzoic acid methyl ester
11.7 wt % d-tocopherol
7.4 wt % (1S)-(−)-borneol: (endo-(1S)-1,7,7-trimethyl-bicyclo[2.2.1]heptan-2-ol)
13.5 wt % inert filler (silica gel)

A 5 g portion of this mixture was broadly distributed on the bottom of a 25 mL glass beaker and this was placed in a glass jar (capacity 1 L). A second glass beaker containing 10 mL deionized water was positioned next to the glass beaker. Then a test body frame was introduced into it, with four of the purified standard test rings suspended on the test body frame, each at an angle of 45° to the horizontal. In each batch, these test rings were made of the following materials; low-alloy steel 100Cr6, cast iron GGL25, AlMg1SiCu and Cu—SF, free of tarnish films and deposits.

The onset of rust could easily be evaluated visually on the two test bodies listed first. However, the initial phase of corrosion is more difficult to identify on the latter two nonferrous metal test bodies.

To remedy this situation, the surface condition of these test rings was evaluated before the start of the test by measuring the gloss on selected locations. The "GLOSS-comp" measurement system (Optronik, Berlin) was used for this purpose; it recorded the reflection curve composed of the direct and diffuse reflection components, its peak height P/dB being adequately representative of the respective nature of the metal surface.

A loss of gloss due to initial films of tarnish or other corrosion phenomena is usually manifested in lower P values in the Al and Cu base materials in comparison with the starting condition recorded. To show that such changes have taken place, which are difficult to perceive purely visually by the human eye without any optical aids, it is sufficient to determine ΔP/%.

The jars with the metal specimens, the deionized water and the combination of substances according to this invention were sealed tightly, using a cover with a ring gasket and a tension bracket. After a waiting period of 16 hours at room temperature, the so-called buildup phase of the VCI components within the container could be regarded as concluded. The individual jars were then exposed for 16 hours in a heating cabinet at 40° C., then again for eight hours at room temperature. This cyclic load (1 cycle=24 hours) was repeated until visual changes could be discerned in the test bodies through the glass wall, or a maximum load of 42 cycles was waited.

After the end of the test, the ΔP/% values were recorded for the individual Al and Cu rings. The steel and cast iron test bodies were only evaluated visually.

In reference to the substance mixture according to this invention, 5 g portions of a conventional VCI powder were tested in the same way. This reference VCI powder (R1) consisted of:

54.0 wt % monoethanolamine benzoate
23.0 wt % 1H-benzotriazole
23.0 wt % filler (silica gel)

Results of the Test:

The test bodies made of ferrous materials, which had been used together with the substance mixture according to this invention, showed no change in appearance after 42 cycles in all four parallel batches. The same thing was also true of the Al and Cu test bodies which were evaluated as $0 \leqq \Delta P\% \leqq +0.5$ after 42 cycles. It can be concluded from these findings that their shiny metallic appearance remained unchanged in humid air saturated with the substance combination according to this invention.

In the batches with the conventional commercial reference system, the test bodies made of GGL25 showed initial spots of rust after eight to ten cycles, rapidly increasing in size as the tests were continued. Edge rust was observed on the steel rings after eleven to twelve cycles.

Here again, the gloss behavior of the Al and Cu test bodies was measured only after 42 cycles. A reduction in gloss was always found, characterized by negative ΔP values/%, much more pronounced in the case of AlMg1SiCu with −2.1 as the average then in the case of Cu—SF with −0.3.

Consequently, the reference system is suitable only for VCI corrosion protection of Cu base materials. From the example described here, the VCI effect of the substance combination according to this invention is manifested very advantageously with respect to the conventional utilitarian metals by comparison.

EXAMPLE 2

The following substance combination according to this invention was prepared from the anhydrous substances:

20.0 wt % sodium nitrite
11.0 wt % 2-(2H-benzotriazol-2-yl)-4-methylphenol
11.5 wt % 2,4-dihydroxybenzoic acid methyl ester
12.7 wt % tocopherol (RRR-α-tocopherol)
25.6 wt % sodium benzoate
6.8 wt % benzoic acid
12.4 wt % (+)-borneol, (endo-(1R)-1,7,7-trimethylbicyclo-[2.2.1]heptan-2-ol)
and a 5% solution of this in ethanol (90%) plus water was prepared.

An aqueous alcoholic acid sol which was prepared according to Unexamined German Patent 19708285 from 50 mL tetraethoxy-silane, 200 mL ethanol and 100 mL 0.01 N hydrochloric acid by stirring for 20 hours at room temperature, and which then had a 4.2% solids content in 70% ethanol at a pH of 4, was mixed with 50 mL of the 5% solution of the substance combination according to this invention and used to coat paper (kraft paper 70 g/m$^2$) by wet rolling. Immediately after air drying the VPI paper prepared in this way, its corrosion-preventing effect was tested in comparison with a conventional corrosion-preventing paper which was used as the reference system (R2). The reference system (R2) contained, according to chemical analysis, the active ingredients dicyclohexylamine nitrite, cyclohexylamine caprylate and benzotriazole, the total amount being approximately comparable to the substance combination according to this invention.

Test bodies in the form of rings (standard test rings) of low-alloy steel 100Cr6, cast iron GG125, AlMg1SiCu and Cu—SF were used again by analogy with Example 1, and the testing ritual was also like that described in Example 1. The only difference here was that instead of the VCI powder mixture, now the individual jars were lined with VCI paper, each with one circular section cut with a diameter of 8 cm on the bottom, a lateral surface of 13×28 cm and another circular section with a diameter of 9 cm for the cover. Then the test body frame and the glass beaker containing the deionized water were placed in position, the jar was closed and the climate loading was performed as described in Example 1.

However, the condition of the test objects could not be observed through the glass wall in this case, so the batches were opened briefly for this purpose after every fifth cycle during the room temperature phase. If no changes could be discerned visually, the climate loading was continued in the manner described above.

Results of the Test:

The test bodies which were made of ferrous materials and had been used together with the substance mixture according to this invention again had no change in appearance in all three parallel batches after 42 cycles.

The same thing was also true for the Al and Cu test bodies which were again evaluated by $0 \leqq \Delta P/\% \leqq +0.5$ after 42 cycles. It follows from this that their shiny metallic appearance had remained unchanged in humid air saturated with the substance combination according to this invention.

In the batches with the conventional commercial reference system, the test bodies made of GGL25 showed initial spots of rusting after 8 to 10 cycles, and the spots rapidly increased in size as the tests were continued. After 11 to 12 cycles, edge rust could be observed on the steel rings.

The gloss behavior of the Al and Cu test bodies was measured again only after 42 cycles. A reduction in gloss was always found, characterized by negative ΔP/% values, with an average of −3.5 in the case of AlMg1SiCu, which was again much more marked than −0.5 in the case of Cu—SF.

Consequently, the reference system has only limited stability for VCI corrosion protection of Cu base materials, whereas the substance combination according to this invention, as shown by the example, manifests reliable VCI properties even under the extreme humid air conditions, with respect to the conventional metals for use.

EXAMPLE 3

The following substance combination was prepared from the anhydrous substances:

| | |
|---|---|
| 22.4 wt % | sodium nitrite |
| 6.0 wt % | 2,6-di-tert-butyl-4-methoxyphenol |
| 14.7 wt % | 2-(2H-benzotriazol-2-yl)-4,6-di-tert-butylphenol |
| 15.7 wt % | 2,4-dihydroxybenzoic acid ethyl ester |
| 12.7 wt % | tocopherol (RRR-α-tocopherol) |
| 12.4 wt % | 2,6-diisopropylnaphthalene |
| 8.1 wt % | calcium stearate |
| 7.8 wt % | calcium carbonate (slip) |
| 2.2 wt % | silica gel (antiblock) |

35 wt % of this mixture was mixed with 65 wt % of a conventional LD-PE and processed to yield a VCI master batch. A Rheocord 90 (Haake) extruder with contra-rotating twin screws was used. At cylinder temperatures of 150° C. and a nozzle temperature of 158° C., this mixture was extruded at a screw speed of 65 to 80 rpm and granulated by cold chopping. This granulated VCI master batch was processed further by blow molding to yield VCI films, for which purpose the extruder was equipped with a single screw and a ring nozzle. After thoroughly mixing 3 wt % of the VCI master batch with 97 wt % of a conventional LDPE granular batch, processing was continued at cylinder temperatures of 175° C. and a nozzle outlet temperature of 180° C. while the screw speed was varied between 80 and 85 rpm. A VCI film with an average layer thickness of 80 μm was produced (VCI(3)).

The VCI film VCI(3) produced in this way using a substance combination according to this invention was processed to produce bags (cutting and welding of the superimposed side seams). Sheets of the metal materials of carbon steel C25, cold rolled (90×50×1) mm$^3$ (Q-Panel, Q-Panel Lab Products, Cleveland, Ohio USA 44145) and flame-galvanized steel (ZnSt) with a Zn layer (EKO Stahl GmbH, D-15872 Eisenhüttenstadt) were each positioned in a perpendicular (⊥) arrangement inside of spacer frames and welded in a prefabricated bag.

The reference system (R3) used was a conventional VCI film, which contained, according to chemical analysis, dicyclohexylamine nitrite, sodium molybdate and sodium benzoate, the total quantity amounting to approximately twice as much in comparison with the VCI components of the substance combination according to this invention, and it had a layer thickness of 110 μm. In addition, similar packagings were also prepared with VCI-free LDPE film, 80 μm.

All of the prepared model packages were stored temporally for approx. 17 hours at room temperature to guarantee the establishment of an atmosphere saturated with the VCI components (buildup phase!) in the packages. Then they were transferred to a climate testing cabinet, model HC 4020 (Vötsch Industrietechnik GmbH, D-72304 Balingen) which was adjusted to the alternating humid air and temperature climate according to DIN EN 60068-2-30, where a 24-hour cycle consisted of the following stages: six hours at 25° C. and (RH)=98%, three-hour heating phase from 25° C. to 55° C. at (RH)=95%, nine hours at 55° C. and (RH)=93% and six-hour cooling phase from 55° C. to 25° C. at (RH)=98% and three hours at 25° C. and (RH)=98%.

The surface of the test metal sheets with the film packaging was inspected through the transparent film material after each cycle.

As soon as visible corrosion phenomena appeared on the model packages, the climate loading was interrupted for the respective sample and the number of cycles that had elapsed until then was recorded.

Results of the Test:

| Packaging | Number of cycles according to DIN EN 60068-2-30 | Surface condition |
|---|---|---|
| C25 ⊥ ZnSt/LDPE, 80 μm | 5<br>7 | first rust at edges of C25;<br>white rust beginning in spots in edge area on ZnSt |
| C25 ⊥ ZnSt/VCI (3), 80 μm | terminated after 80 cycles | no corrosion phenomena on either metal sample |
| C25 ⊥ ZnSt/R3, 100 μm | 25<br>21 | spots of rust on C25;<br>white rust at the contact point of C25 and at cut edges on the ZnSt |

This example documents the superiority of the substance combination according to this invention as a high-performance VCI film packaging material for overseas shipping, the climate conditions of which were simulated with the selected humid air-temperature alternating stress test in a time-compressed manner.

EXAMPLE 4

The following substance combination according to this invention was prepared from the anhydrous substances:

| | |
|---|---|
| 10.0 wt % | sodium nitrite |
| 5.0 wt % | 2,6-di-tert-butyl-4-methylphenol |
| 15.0 wt % | 2-(2H-benzotriazol-2-yl)-4,6-di-tert-butylphenol |
| 16.0 wt % | 2,4-dihydroxybenzoic acid methyl ester |
| 11.6 wt % | d-tocopherol |
| 12.4 wt % | 2,6-diisopropylnaphthalene |
| 11.7 wt % | 1H-benzotriazole |
| 4.3 wt % | calcium stearate |
| 8.2 wt % | zinc oxide (filler) |
| 4.3 wt % | calcium carbonate (slip) |
| 1.5 wt % | silica gel (antiblock) |

35 wt % of this mixture was again mixed with 65 wt % of a conventional LDPE and processed to yield a VCI master batch. The conditions increasing the production of the VCI film also corresponded to those described in Example 3, so that ultimately again a VCI film with an average layer thickness of 80 μm was obtained (VCI(4)).

The VCI film VCI(4) produced using a substance combination according to this invention was partially processed to cut sheets and bags (cutting and welding of the superimposed side seams) and these bags were then used for packaging electronic circuitboards. These were circuitboards with the dimensions 50.8×50.8 mm, which were to be welded in a stack of five boards each with an interlayer of VCI film in a VCI bag. Each circuitboard had a layer system consisting of galvanic Cu (25 μm)/chemical Ni (5 μm)/Sud Au (0.3 μm) whose bondability after storage and shipping operations was to be guaranteed.

A conventional commercial VCI film (R4) was used as the reference VCI packaging material which emitted cyclohexylamine caprylate and benzotriazole as the VCI components and had a layer thickness of 100 μm. In addition, packages were prepared with stacks of circuitboards with LDPE film, 100 μm.

All of the model packages prepared in this way were exposed to the climate conditions according to DIN EN 60068-2-30 as already described in Example 3, and three similar packages were removed from the climate cabinet for bond tests after 20, 25, 30 and 35 cycles. The bond tests on circuitboards freed of packaging material after two hours of storage in dry air at room temperature were performed with the help of a manual Thermosonic Bonder K&S 4124 (60 kHz). Bonding was performed with an Au beta 25 μm bond wire (wire tensile strength >8 cN) in 170 positions per circuitboard at a spacing of 1.7 mm. Then the stability of 50 bond joints was tested by micrometer tester LC 02 and was characterized by determining the breakaway force (test method MIL-883 D).

Bond capability was classified as given if the average of the breakaway force was >10 cN and microscopically detectable cracking had occurred at the bond.

Results of the Test:

All the circuitboards packaged in the substance combination according to this invention and exposed to the climate conditions described above were classified as capable of bonding even after 35 cycles. In the case of the circuitboards packaged in VCI-free LDPE film, however, no bondability was possible after 20 cycles.

Of the circuitboards packaged in the reference VCI film R4, the interim storage time from unpackaging until the bond test first had to be extended from two hours to at least eight hours to be able to form stable bonds in 45% to 37% of the cases on the samples that had been exposed to 20 and 25 cycles. All the samples that had been exposed to more than 25 cycles in VCI film R4, however, had to be classified as no longer bondable.

The example shows that the substance combination according to this invention protects metals from even the slightest surface changes, which are not visually perceptible but can restrict the usability of these metals by forming adsorption films on the metals. With the relatively rapid desorbability of these VCI films, use of the VCI method will be possible even in areas that are promising for the future such as microelectronics, where the VCI systems that were conventional in the past such as that tested here have remained unsuccessful, apparently because they left behind thin conversion layers instead of adsorption films. However, the cleanliness of the metal surfaces, free of adsorption films and conversion layers, is of fundamental importance especially for bonding processes, but that could not be guaranteed with the VCI systems conventional in the past.

What is claimed is:

1. A corrosion-inhibiting substance combination which contains:

(1) an inorganic salt of nitrous acid, (2) a water-insoluble polysubstituted phenol, (3) an aliphatic ester of a dihydroxybenzoic acid, and (4) tocopherol (2,5,7,8-tetramethyl-2-(4',8',12'-trimethyltridecyl)chroman-6-ol).

2. The corrosion-inhibiting substance combination according to claim 1, which also contains (5) a bicyclic terpene or an aliphatically substituted naphthalene as a water vapor-volatile promoter of sublimation component.

3. The corrosion-inhibiting substance combination according to claim 1, containing 0.1 to 40% of component (1), 0.5 to 40% of component (2), 0.5 to 40% of component (3) and 0.5 to 40% of component (4).

4. The corrosion-inhibiting substance combination according to claim 2, containing 0.1 to 40% of component (1), 0.5 to 30% of component (2), 0.5 to 20% of component (3), 0.5 to 20% of component (4) and 0.1 to 10% of component (5).

5. The corrosion-inhibiting substance combination according to claim 2 or 4, wherein the composition is adjusted so that all components will sublime in an amount and at a rate sufficient for vapor space corrosion prevention in a temperature range up to 80° C. at a relative atmospheric humidity (RH)≦98%.

6. The corrosion-inhibiting substance combination according to claim 2 or 4, wherein the bicyclic terpene contained as the promoter of sublimation is preferably derived from the group of bornanes and is a camphor, borneol or a substitution product derived therefrom.

7. The corrosion-inhibiting substance combination according to claim 2 or 4, wherein the aliphatically substituted naphthalene contained as the promoter of sublimation is preferably from the group of naphthalenes with isopropyl group substituents and is 4-isopropyl-1,6-dimethylnaphthalene (cadalene), 2,6-diisopropylnaphthalene.

8. The corrosion-inhibiting substance combination according to claim 1 or 2, containing as an inorganic salt of nitrous acid an alkali nitrite, an alkaline earth nitrite or an ammonium nitrite or mixtures thereof.

9. The corrosion-inhibiting substance combination according to claim 1 or 2, containing as the water-insoluble polysubstituted phenol 2-(2H-benzotriazol-2-yl)-4-methylphenol, 2-(2H-benzotriazol-2-yl)-4,6-di-tert-butylphenol, 2,6-di-tert-butyl-4-methylphenol, 2,6-di-tert-butyl-4-ethylphenol, 2,6-di-tert-butyl-4-methoxyphenol, 2,6-dioctadecyl-4-methylphenol, either alone or in a mixture thereof.

10. The corrosion-inhibiting substance combination according to claim 1 or 2, containing as the aliphatic ester of a dihydroxybenzoic acid 2,4-dihydroxybenzoic acid methyl ester, 2,5-dihydroxybenzoic acid methyl ester, 2,6-dihydroxybenzoic acid methyl ester, 3,5-dihydroxybenzoic acid methyl ester, 3,4-dihydroxybenzoic acid ethyl ester, either alone or in a mixture thereof.

11. The corrosion-inhibiting substance combination according to claim 1 or 2, containing α-tocopherol individually or as a mixture with its stereoisomers.

12. The corrosion-inhibiting substance combination according to claim 2, containing a camphor or a borneol as a bicyclic terpene, either individually or as a mixture thereof.

13. The corrosion-inhibiting substance combination according to claim 1 or 2, also containing 4-isopropyl-1,6-dimethylnaphthalene (cadalene), or 2,6-di-isopropylnaphthalene, either individually or as a mixture.

14. The corrosion-inhibiting substance combination according to claim 2, which also contains in addition to components (1) through (5), individually or as a mixture, substances which form vapor-phase inhibitors.

15. A method of producing a corrosion-inhibiting substance combination that is capable of sublimation, comprising the step of mixing (1) an inorganic salt of nitrous acid, (2) a water-insoluble polysubstituted phenol, (3) an aliphatic ester of a dihydroxybenzoic acid and (4) tocopherol together.

16. The method according to claim 15, additionally comprising the step of adding (5) a bicyclic terpene or an aliphatically substituted naphthalene.

17. The method according to one of claim 15 or 16, wherein the percentage of the ingredients mixed together are 0.1 to 40% of component (1), 0.5 to 30% of component (2), 0.5 to 20% of component (3), 0.5 to 20% of component (4) and 0.1 to 0% of component (5).

* * * * *